United States Patent [19]

Leach et al.

[11] 4,145,903

[45] Mar. 27, 1979

[54] SHEET FORMING METHOD AND APPARATUS

[75] Inventors: Almon E. Leach, Lockport; Frank J. Dietrich, Tonawanda; James P. Morris, Amherst, all of N.Y.

[73] Assignee: Textron Inc., Providence, R.I.

[21] Appl. No.: 892,665

[22] Filed: Apr. 3, 1978

[51] Int. Cl.[2] ..... B21D 22/10

[52] U.S. Cl. ..... 72/60; 72/342; 72/364

[58] Field of Search ..... 72/342, 364, 60, DIG. 12, 72/DIG. 13; 29/421 R

[56] References Cited

U.S. PATENT DOCUMENTS

| | | | |
|---|---|---|---|
| 537,481 | 4/1895 | Parker | 72/60 |
| 3,313,138 | 4/1967 | Spring et al. | 72/364 |
| 3,418,836 | 12/1968 | Olson | 72/364 X |
| 3,516,274 | 6/1970 | Graham et al. | 72/342 X |
| 3,595,060 | 7/1971 | Mundy | 72/364 |
| 3,768,142 | 10/1973 | Raczel | 72/364 |

*Primary Examiner*—Leon Gilden

*Attorney, Agent, or Firm*—Bean, Kauffman & Bean

[57] ABSTRACT

A method and apparatus for forming a superplastic metal sheet features the utilization of a plunger movable within a chamber filled with finely divided particulate material to create a column of material arranged to bear against the metal sheet and effect mold forming thereof within a mold cavity heated to required superplastic forming temperature. The material additionally aids in minimizing loss of heat from the mold cavity and insures against non-uniform heating of the metal sheet.

6 Claims, 5 Drawing Figures

SHEET FORMING METHOD AND APPARATUS

BACKGROUND OF THE INVENTION

It is known that certain metal alloys and particularly certain titanium alloys, such as Ti-6Al-4V, which are widely used in the Aerospace industry, exhibit superplastic behavior. Superplasticity is the capability of a material to undergo unusually large elongations before necking, while maintained within given ranges of temperature and strain rate.

As by way of specific examples, Ti-6Al-4V alloy demonstrates superplastic behavior and can be made to undergo elongations greater than 100% when maintained at temperatures within the range of about 1500°-1800° F. and subjected to strain rates in the range of about $10^{-6}$ to $10^{-3}$ inch/inch/second.

Presently known commercial apparatus adapted for use in effecting superplastic forming of titanium alloy sheets typically employ differential pressures within an inert gas environment to effect mold forming of sheets against a female mold. Apparatus of this type, which is disclosed for instance in U.S. Pat. No. 3,934,441, is expensive to construct and operate and has the additional disadvantage of requiring the use of mechanical seals to maintain the gas environment, which act to prevent/interfere with conventional draw forming of the sheet material incident to the superplastic forming operation.

The utilization of gas or liquid pressure mediums in superplastic forming apparatus is also disclosed, as by way of further example, by U.S. Pat. Nos. 3,529,458 and 3,898,827.

It has also been proposed in U.S. Pat. No. 3,768,142 to employ a heat expandable polymeric foam material to apply forming pressure to a zinc-aluminum alloy sheet subjected to a superplastic forming temperature on the order of about 550° F.; and in U.S. Pat. No. 3,605,477 to form titanium alloy blanks by contact with mated heated forming tools after the blanks have been raised to forming temperature in a separate heating unit. These proposals possess certain drawbacks overcome by the above mentioned inert gas forming operation and/or are not susceptible for use for all known superplastic materials.

Lastly, Applicant has been appraised of U.S. Pat. No. 699,018, which is directed towards an apparatus for forming dental plates, wherein sand is employed as the forming or pressure transmitting medium. In the use of this apparatus, a metal plate is laid on a die disposed at the bottom of a cylindrical forming chamber and the chamber subsequently filled with a charge of sand. A mechanically coupled plunger-sleeve device is then inserted into the upper end of the chamber and the charge of sand compacted to effect initial forming of the metal plate by means of hammer blows applied to the plunger, The forming operation is completed by replacing the original plunger successively with one or more additional plungers, which are freely movable relative to the sleeve, and applying hammer blows to the additional plunger(s) until the metal plate is given its final form. The metal plate may be heated externally of the apparatus.

SUMMARY OF THE INVENTION

The present invention is directed towards a method and apparatus for forming sheet materials by utilizing a plunger within a chamber filled with a finely divided particulate material to create a column of material arranged to bear against the sheet and effect mold forming thereof within a mold cavity.

In accordance with a preferred form of the present invention the mold cavity is heated to a temperature permitting superplastic forming of metal sheet materials.

DRAWINGS

DETAILED DESCRIPTION

Figure 1:
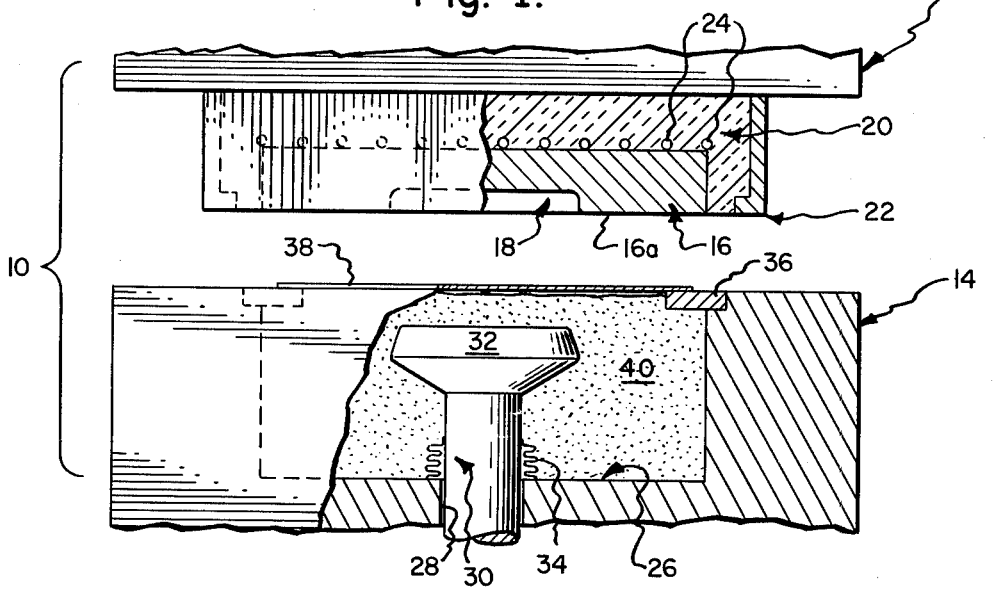
FIG. 1 is an elevational view, partially in section, of a press adapted for use in the practice of the present invention.

Reference is now made specifically to FIG. 1, wherein a press adapted for use in the practice of the present invention is generally designated as 10 and shown as including upper and lower press platens 12 and 14, respectively. Platens 12 and 14 are suitably supported for relative converging movements under the control of a fluid cylinder(s), not shown, between remote press open and adjacent press closed positions shown in FIGS. 1 and 2, respectively.

Figure 2:
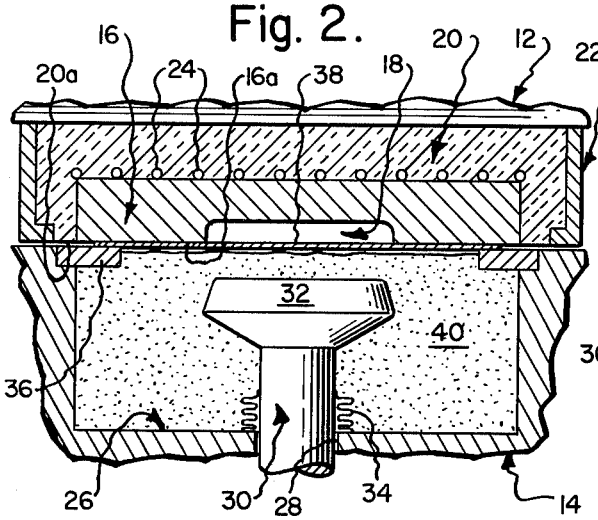
FIG. 2 is a view similar to FIG. 1, but showing the press in closed condition.
Figure 3:
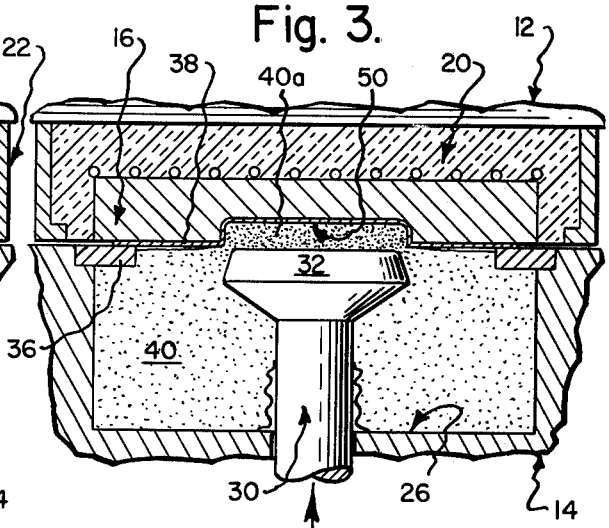
FIG. 3 is a view similar to FIG. 2, but illustrating a completed forming operation.
Figure 4:
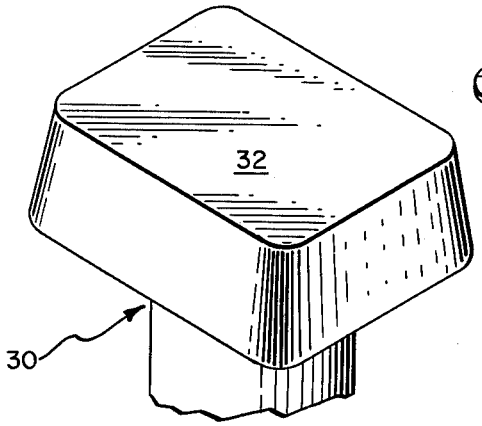
FIG. 4 is a perspective view of a plunger adapted for use in the present invention.

Upper platen 12 is shown in FIGS. 1-3 as carrying a dependent assembly including a metal female mold 16 having a downwardly opening mold cavity 18; a heat insulating enclosure 20 formed of ceramic or other suitable heat insulating material preferably entirely bounding the upper and side surfaces of mold 16; and a suitable mounting/containing device or box 22 for use in attaching mold 16 and enclosure 20 to the lower surface of upper platen 12.

Suitable heating means, such as electric resistance heating elements 24 imbedded in enclosure 20 adjacent mold 16, are provided for the purpose of heating the mold and thus the surface of mold cavity 18 to a temperature suitable for superplastic forming, e.g. within the approximate range of 1500° to 1800° F. in the case of titanium alloys.

Lower platen 14 or a suitable housing supported thereon is formed with an upwardly opening chamber 26, which is vertically aligned with mold cavity 18, and arranged in communication with a vertically extending opening 28 sized to receive a plunger 30 having a head portion 32 fixed to its upper end. Preferably, plunger 30 is loosely fitted with opening 28 and sealed relatively thereto by suitable means, such as a flexible bellows 34, permitting vertically directed reciprocating movements of the plunger within the confines of chamber 26. It will be understood that plunger head portion 32 is vertically aligned with mold cavity 18 and preferably has a plan form size and configuration corresponding essentially to that of the mold cavity. It will also be understood that chamber 26 preferably has a vertical dimension sufficient to accommodate for the entire extent of vertical reciprocating movements of plunger 30 between its lower or retracted and upper or extended positions shown in FIGS. 2 and 3, respectively, and a plan form size substantially larger than that of plunger head 32 and preferably equal to or greater than the plan form size of mold 16.

Chamber 26 is shown in FIGS. 1–3 as being peripherally bounded by a clamping means in the form of a ring or band 36, which cooperates with a portion of the lower surface 16*a* of mold 16 peripherally bounding cavity 18, to releasably clamp a metal sheet or workpiece 38 to be subjected to a forming operation. Ring 36 would preferably extend outwardly of the side surfaces of mold 16 for alignment with the lower surface 20 of enclosure 20.

A volume of finely divided or particulate material 40 is deposited in chamber 26, such as to fully immerse plunger 30 and essentially fill the chamber. This material would preferably possess good refractory properties and be of a particle size and surface finish demonstrating maximum fluid flow characteristics within the range of temperatures at which forming of sheet 38 is to be effected. Otherwise stated, material would preferably be free flowing, possess good thermal insulating properties, and not be subject to softening, lumping or reaction with the sheet being formed and/or the molding apparatus within the range of forming temperatures. Experiments have indicated that diverse types of ceramic materials having a wide range of particle sizes may be employed in the practice of the present invention. As by way of example, Silica flour having a mesh size finer than 280 grit; Zirconia having a mesh size of about 160 grit; Alundum having a mesh size of 80 grit; and Glass Beads having a mesh size of between 20 and 40 grit have been found susceptible of use. However, a ceramic material having a maximum particle size of 80 grit are preferred in that it has been found that larger particles tend to produce an undesirably rough finish on the formed article.

Preferably, the upper surface of material 40 deposited within chamber 26 would be slightly below the upper surface of ring 36 in order to permit sheet 38 to be laid flatwise on ring 36 when inserted into press 10, as viewed in FIG. 1, and the depth of such material covering plunger 32 would be at least equal to and preferably greater than the depth of mold cavity 18. The plan form size and overall depth of chamber 26 is such as to provide a volume of material sufficient to minimize loss of heat from mold 16, to accommodate for variations in size of articles to be formed and to insure against nonuniform heating of metal sheet 38.

In operation, metal sheet 38 is laid flatwise on ring 36, as indicated in FIG. 1, and press closed in order to peripherally clamp the metal sheet between ring 36 and mold surface 16*a*, as indicated in FIG. 2. After heating mold 16 and thereby metal sheet 38 to a temperature required to effect superplastic forming, plunger 30 is slowly raised into its fully extended position, illustrated in FIG. 3, to effect forming of the metal sheet into an article, which closely conforms to the surface configuration of mold cavity 18 and is designed as 50 in FIGS. 3 and 5.

Figure 5:
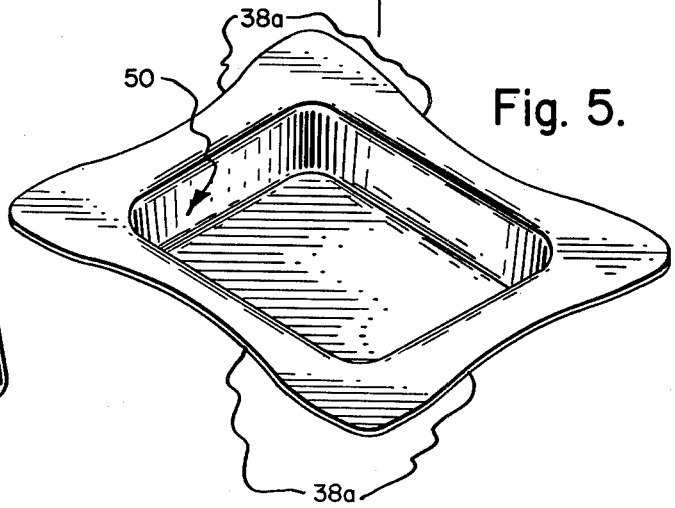
FIG. 5 is a perspective view of an article formed by use of the present invention.

Preferably, the degree of clamping pressure exerted on the peripheral portions of the metal sheet is not in excess of that which will permit conventional "drawing" of the metal sheet, as indicated in areas designated as 38*a* in FIG. 5, in order to minimize/localize "thinning" of the central portion of the metal sheet subjected to superplastic forming operation. However, tests have indicated that it is necessary to employ ring 36 to apply constraint to the peripheral portions of the metal sheet during the molding operation and that such constraint must be greater than that afforded by the material in chamber 26 bounding plunger 30.

Tests have also indicated that the quality of the molding operation decreases as the plan form size and/or configuration of the plunger head departs from that of the mold cavity.

It would appear that, as plunger 30 moves within chamber 26 towards mold cavity 16, plunger head 32 creates a column 40*a* within the volume of material 40 and then forces such column to first bear on metal sheet 38 and subsequently effect progressive deformation of the metal sheet until completely formed as article 50 within mold cavity 18. The material within column 40 appears to be tightly compacted and to move freely relative to the remaining material within chamber 26. However, the flow characteristics of the material within column 40*a* permits progressive changes in its upper surface configuration, as required to follow changes in the shape of the metal sheet as it progressively conforms to the surface configuration of mold cavity 18.

The present invention is believed to possess utility in forming essentially all materials demonstrating superplastic properties, it being understood that the forming temperatures of the female mold and the strain rates established by the speed of operation of the plunger will vary depending on the individual characteristics of superplastic materials being formed. Moreover, it is believed that the invention also possesses utility in the forming of diverse sheet materials under normal hot forming temperature conditions.

What is claimed is:

1. A method for forming sheet material which comprises:

providing a female mold cavity having a surface complimentary to a shape desired to be formed;

providing a plunger arranged in alignment with said mold cavity and having a plan form size and configuration corresponding essentially to the plan form size and configuration of said mold cavity;

providing a confined volume of finely divided material exceeding the volume of said mold cavity, said confined volume being arranged intermediate said plunger and said mold cavity;

placing said sheet material intermediate said confined volume and said mold cavity;

peripherally clamping said sheet material;

heating said mold cavity at a temperature suitable for forming said sheet material; and moving said plunger towards said mold cavity to create a column of said material within said confined volume and force said column to bear on said sheet material and effect mold forming thereof within said mold cavity.

2. A method according to claim 1, wherein said sheet material is formed of a superplastic metal, and said mold cavity is heated to a superplastic forming temperature.

3. A method for forming sheet material which comprises:

providing a press mounting a downwardly opening mold cavity and an upwardly opening chamber in vertical alignment and for relative converging movements between remote press open and adjacent press closed positions, said mold cavity lying wholly within the confines of said chamber as viewed in plan and said mold cavity having a depth less than the depth of said chamber;

providing a plunger arranged within said chamber and disposed in vertical alignment with said mold cavity, said plunger having a plan form size and configuration corresponding essentially to the plan form size and configuration of said mold cavity;

at least essentially filling said chamber with a volume of finely divided material to completely immerse said plunger;

placing said sheet material intermediate said chamber and said mold cavity;

closing said press and incidental thereto peripherally clamping said sheet material outwardly of the confines of said mold cavity;

heating said mold cavity at a temperature suitable for forming of said sheet material; and moving said plunger vertically towards said mold cavity to create a column of said material within said volume and force said column to bear on said sheet material and effect mold forming thereof within said mold cavity.

4. A method according to claim 3, wherein said plunger is moved wholly within the vertical confines of said chamber during mold forming of said sheet material.

5. A method according to claim 4, wherein said sheet material is formed of a superplastic metal, and said mold cavity is heated to a superplastic forming temperature.

6. An apparatus for forming sheet material, which comprises in combination:

a downwardly opening female mold cavity peripherally bounded by an upper clamping surface;

means to heat said mold cavity to a temperature suitable for forming said sheet material;

a chamber opening upwardly towards said mold cavity and being peripherally bounded by a lower clamping surface, said lower clamping surface being arranged in cooperative alignment with said upper clamping surface for clamping said sheet material outwardly of said mold cavity;

a plunger supported for vertical movements within said chamber, said plunger having an upwardly facing surface aligned with and having a plan form size and configuration conforming essentially to the plan form size and configuration of said mold cavity;

a volume of finely divided and flowable material substantially filling said chamber and wholly immersing said plunger;

means for moving said mold cavity and said chamber relatively towards one another for placing said upper and lower clamping surfaces in clamping engagement with said sheet material; and means for moving said plunger within the limits of the vertical confines of said chamber relatively towards said mold cavity for creating a column of material bearing on said sheet material in alignment with said mold cavity and moving said column upwardly into the confines of said mold cavity to effect essential conforming engagement of said sheet material with the surface of said mold cavity.

* * * * *